US006276067B1

(12) United States Patent
Hsu

(10) Patent No.: US 6,276,067 B1
(45) Date of Patent: Aug. 21, 2001

(54) ELLIPSE DRAWING/CUTTING DEVICE

(75) Inventor: Walter W. Hsu, Yinlin Hsien (TW)

(73) Assignee: Welter's Co., Ltd., Yinlin Hsien (TW)

( * ) Notice: Subject to any disclaimer, the term of this patent is extended or adjusted under 35 U.S.C. 154(b) by 0 days.

(21) Appl. No.: 09/482,578

(22) Filed: Jan. 13, 2000

(51) Int. Cl.[7] ..... B43L 11/04
(52) U.S. Cl. ..... 33/30.1; 33/30.4
(58) Field of Search ..... 33/30.2, 27.01, 33/30.1, 30.4, 30.6, 30.7, 31

(56) References Cited

U.S. PATENT DOCUMENTS

| | | | | |
|---|---|---|---|---|
| 2,623,286 | * | 12/1952 | Barker | 33/30.4 |
| 4,563,819 | * | 1/1986 | Ching et al. | 33/30.4 |
| 4,570,344 | * | 2/1986 | Clegg | 33/30.1 |
| 4,624,057 | * | 11/1986 | Hursey | 33/27.01 |

* cited by examiner

*Primary Examiner*—Christopher W. Fulton
(74) *Attorney, Agent, or Firm*—Browdy and Neimark

(57) ABSTRACT

An ellipse drawing/cutting device is made up a base plate, a driving gear, a coil spring, a driven gear, a position retaining arm, a compression spring, a longitudinal measurement disc, a first fixing ring cover for the longitudinal measurement disc, a lateral measurement disc, a second fixing ring cover for the lateral measurement disc, a slide bracket assembly including a ruler frame, a pair of slide wings and cover two plates; a link bar, a plurality of anti-slip blocks disposed under the base plate, and a plurality of differently spaced pen insertion holes are distributed on the ruler frame which is relatively slidable on the lateral measurement disc. The longitudinal measurement disc and the lateral measurement disc are connected to each other by the link bar and movable in synchronism by way of the driven gear actuated by the spring operated driving gear so that a pen can be selectively inserted in proper one of the insertion holes to draw ellipses of different dimensions within ranges defined by the sizes of the longitudinal and lateral measurement discs.

13 Claims, 7 Drawing Sheets

ELLIPSE DRAWING/CUTTING DEVICE

BACKGROUND OF THE INVENTION

The present invention relates to an ellipse drawing/cutting device which is mainly made up of a base plate, a driving gear, a coil spring, a driven gear, a position retaining arm, a compression spring, a longitudinal measurement disc, a first fixing ring cover for the longitudinal measurement disc, a lateral measurement disc, a second fixing ring cover for the lateral measurement disc, a slide bracket assembly including a ruler frame, cover plates for the slide bracket assembly, a link bar, a plurality of anti-slip blocks disposed under the base plate, and a plurality of differently spaced pen insertion holes are distributed on the ruler frame which is relatively slidable on the lateral measurement disc. The longitudinal measurement disc and the lateral measurement disc are connected to each other by the link bar and movable in synchronism by way of the driven gear actuated by the spring operated driving gear so that a pen can be selectively inserted in a proper one of the insertion holes to draw ellipses of different dimensions within ranges defined by the sizes of the longitudinal and lateral measurement discs.

Traditionally, people draw ellipses by selection of proper ellipsographs of fixed sizes. Those plastic ellipsographs are produced by injection molding art and are fixed in their dimensions. So, to draw ellipses of various sizes, a person must choose different ellipsographs to meet the needs. It is very inconvenient because a plurality of ellipsographs must be ready at hand when different ellipses are to be drawn. Thus, it is time consuming in locating a proper ellipsograph every time and also not economical in cost for people to purchase a plurality of ellipsographs.

SUMMARY OF THE INVENTION

Therefore, the primary object of the present invention is to provide an ellipse drawing/cutting device, which can draw or cut ellipses of different dimensions in a simple and speedy manner. A number of replaceable ruler frames are selectively mounted to a lateral measurement disc of the base plate in accordance with practical requirements. Each ruler frame can be used to draw or cut ellipses of various dimensions with ease.

Another object of the present invention is to provide an ellipse drawing/cutting device, which is provided with a number of small-size replaceable ruler frames so that they are easy for storage and carrying and cheap to produce.

DETAILED DESCRIPTION OF THE PREFERRED EMBODIMENTS

Figures 1, 1A:
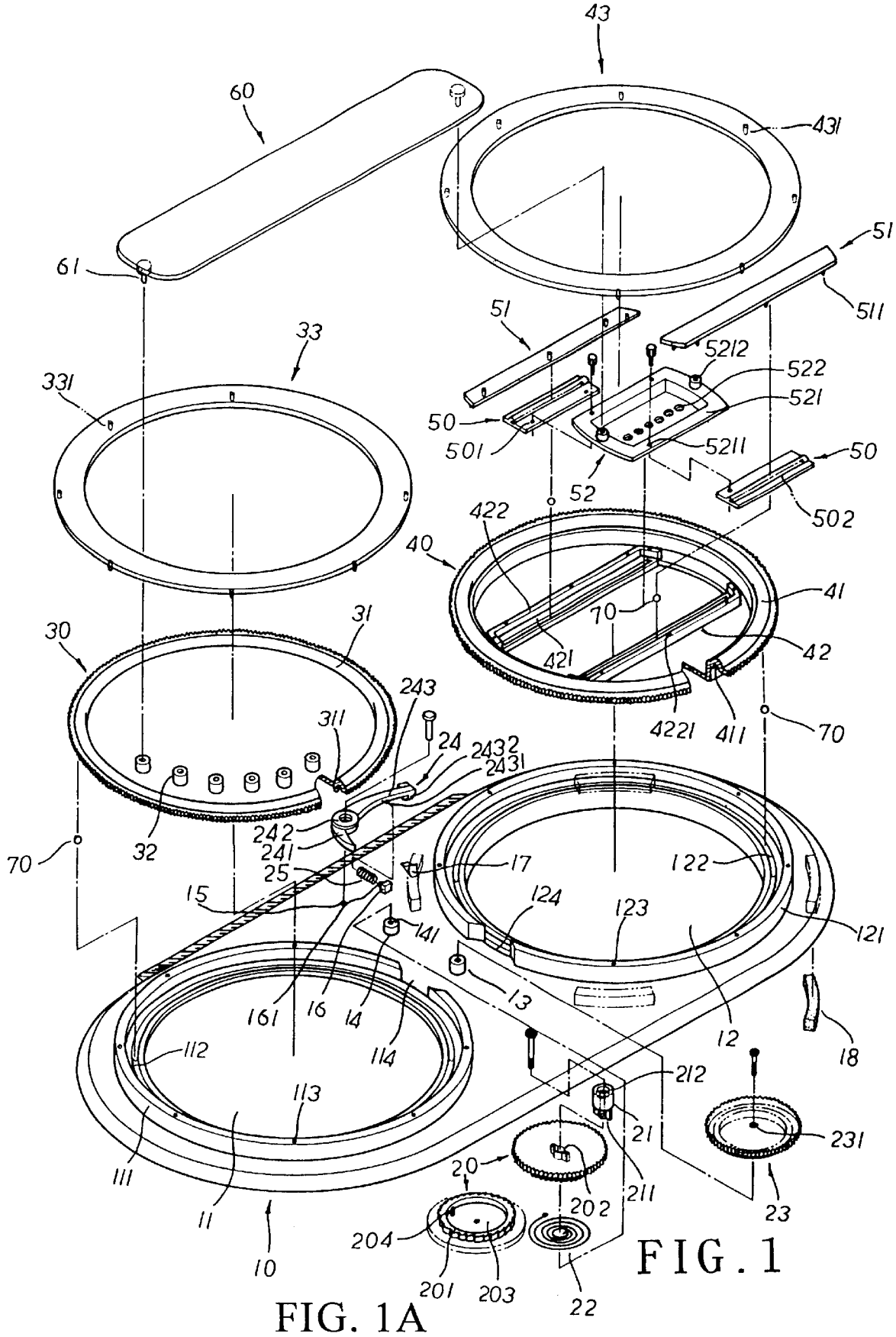
FIG. 1 is a perspective diagram showing the exploded components of the present invention.
FIG. 1A is a diagram showing the reverse side of a driving gear of the present invention.

Referring to FIG. 1, an improved ellipse drawing/cutting device of the present invention comprises a base plate 10, a driving gear 20, a turning knob 21, a coil torsion spring 22, a driven gear 23, a position retaining pivot arm 24, a compression spring 25, a longitudinal measurement disc 30, a first fixing ring lid 33 for the longitudinal measurement disc 30, a lateral measurement disc 40, a second fixing ring lid 43 for the lateral measurement disc 40, a slide bracket assembly including elongated cover plates 51, a left and right slide wings 50, a ruler frame 52 and a pair of parallel guide tracks 42; a link bar 60 and a plurality of steel beads 70, and a plurality of anti-slip blocks 18 disposed under the base plate 10, and a plurality of differently spaced pen insertion holes are linearly disposed on the ruler frame 52.

The base plate 10 has a left round cavity 11 and a right round cavity 12 for respectively receiving the longitudinal measurement disc 30 and said lateral measurement disc therein 40 that are rotatable within the round cavities. Both the round cavities 11, 12 have a vertically risen retaining flange wall 111 and 121 respectively on the periphery thereof. Adjacent to each risen retaining flange wall 111, 121 is disposed a peripheral guiding groove 112, 122.

A plurality of spaced engaging bores 113 are distributed on a top surface of the risen retaining flange wall 111 of the left round cavity 11 and a cut 114 is disposed on the risen retaining flange wall 111. Also a plurality of spaced engaging bores 113 are distributed on a top surface of the risen retaining flange wall 121 of the right round cavity 12 and a cut 124 is disposed on the risen retaining flange wall 121.

At the center of the base plate 10 is disposed a pivot post 13 onto which the driven gear 23 is mounted. A turning knob pivot post 14 and a mounting hole 15 are placed adjacent the pivot post 13 and the turning knob post 14 has a longitudinal locking groove 141 defined on one side of a periphery thereof. A plurality of anti-slip blocks 18 are disposed under the base plate 10 to prevent the base plate from slipping in operation.

Next to the mounting hole 15 are located a spring retaining seat 16 and a limiting post 17. A horizontal retaining rod 161 extends from one side of the spring retaining seat 16. The driving gear 20 is a two-layer disc having a large disc provided with gear teeth on a peripheral surface thereof and a small ring portion disposed under the large disc. On a peripheral surface of the small ring portion are disposed a plurality of continuous ratchet teeth 201. A central receiving cavity 203 is defined in the small ring portion on an underside of the driving gear 20.

On a top surface of the driving gear 20 is disposed a locking means 202 for fixing the turning knob 21 in position. In the central receiving cavity 203 and at one point near the small ring portion is disposed a retaining column 204. The turning knob 21 is a two-stage cylinder block having a small diameter rod and a flat insertion portion 211. At the center of the turning knob 21 is provided with a countersunk fixing hole 212.

The driven gear 23 is a two-stage structure having a large diameter disc and a small diameter ring section. On the peripheral surface of the large diameter disc are disposed a plurality of gear teeth. At the center of the large diameter disc is disposed a pivot hole 231 with a cavity defined in the central portion of the underside ring section.

The long position retaining pivot arm 24 has a horn-like retaining head section 241, a central pivot-mounting hole 242 and a rear pivot handle section 243. On a side wall of the rear pivot handle section 243 is disposed a protruded rod 2431 and a limiting block 2432 at the rear end.

The longitudinal measurement disc 30 having a diameter slightly smaller than the inner diameter of the round cavity 11 is provided with a downwardly folded engagement skirt flange 31. A semi-circular guiding groove 311 is formed in the engagement skirt flange 31. On the bottom edge of the engagement skirt flange 31 are peripherally disposed a plurality of gear teeth. On the central area of the longitudinal measurement disc 30 are disposed a plurality of cylindrical retaining posts 32 which are spirally distributed away from the center of and fully distributed on the longitudinal measurement disc 30. A first fixing ring cover 33 having a plurality of protruded retaining poles 331 disposed on the underside thereof is of a proper width.

The lateral measurement disc 40 having a central through hole area has a diameter smaller than the inner diameter of the round cavity 12. The peripheral edge of the lateral measurement disc 40 is provided with a downwardly folded engagement skirt flange 41 having a semi-circular guiding groove 411. The peripheral edge of the lateral measurement disc 40 is provided with a plurality of gear teeth. There are two parallel guide tracks 42 each having a semi-circular grooves 421. A mounting edge 422 disposed on each guide tracks 42 is provided with a plurality of insertion holes 4221. A second fixing ring cover 43 having a plurality of retaining poles 431 disposed on the underside thereof has a proper width.

The slide bracket assembly is equipped with a left slide wing 50 and a right slide wing 50 that are removably attached to a ruler frame 52. There are two elongated cover plates 51 that are attached to the guide tracks 42 of the lateral measurement disc 40 by way of a plurality of protrusions 511 disposed on the underside of each cover plate 51. Thereby the ruler frame 52 in a box form have peripheral side flange 521 can be slidably engaged with the guide tracks 42 by way of the left and right slide wings 50. Each slide wing 50 has screw holes 501 defined thereon so as to permit screws to be led through the screw holes 5211 on the peripheral side flange 521 for securing the left and right slide wings 50 in place. A recessed groove 502 is disposed on each left and right slide wings 50. At each of the lateral sides of the peripheral side flange 521 is respectively disposed a retaining post 5212. A plurality of linearly arranged insertion holes 522 spaced at different distances are disposed on the ruler frame 52 with numerals indicating sizes of ellipses marked beside each insertion hole 522.

The link bar 60 is an elongated plate having a coupling pin 61 disposed on the underside at each end thereof so that the link bar 60 can be selectively engaged with one of the cylindrical retaining posts 32 at one end and with one of the insertion holes 522 of the ruler frame 52 at the other end whereby the ruler frame 52 can be linearly and rotarily moved in synchronism with the rotatable longitudinal measurement disc 30.

Figure 2:
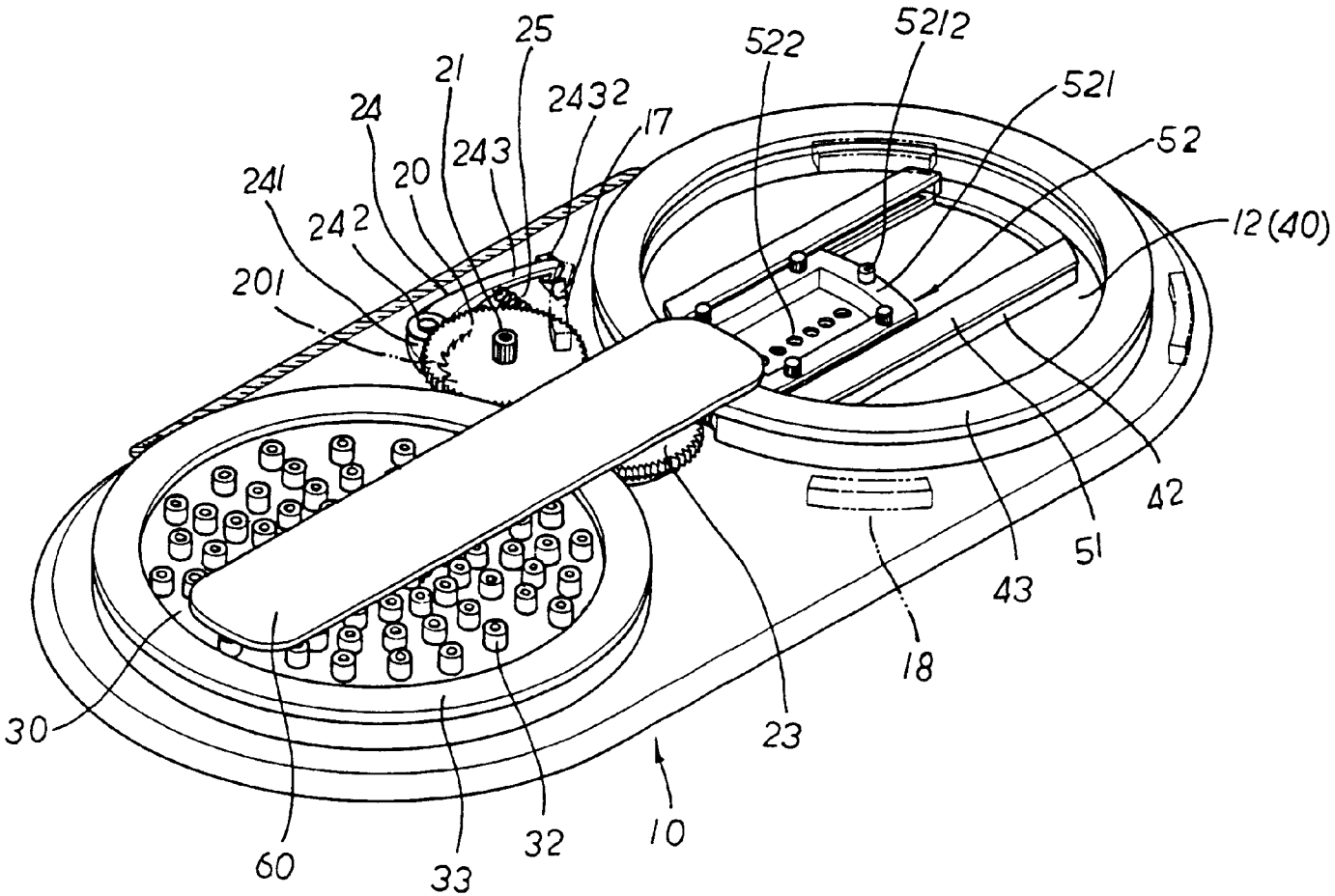
FIG. 2 is a perspective diagram showing the assembly of the present invention.
Figure 3A:
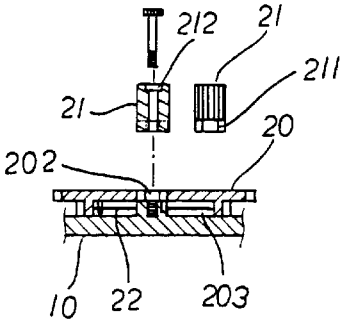
FIG. 3A is a partial sectional diagram showing some exploded components of the present invention.
Figure 3:
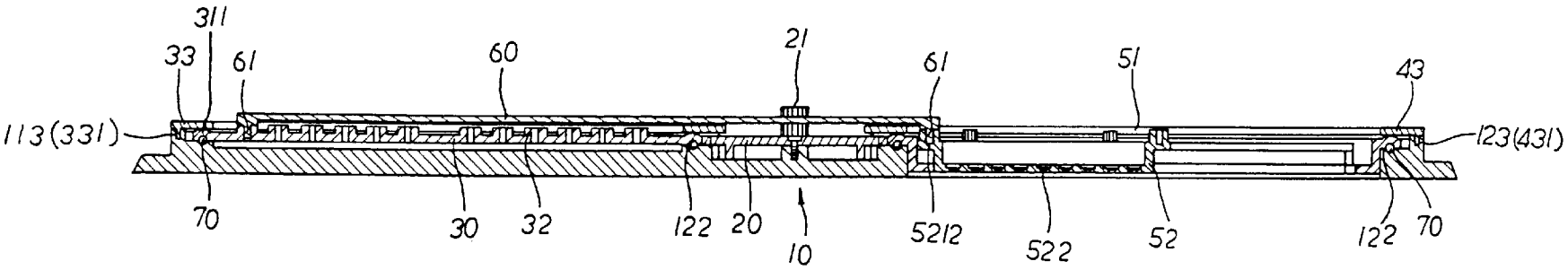
FIG. 3 is a sectional diagram of the assembly of the present invention.

In assembly, as shown in FIGS. 2, 3, 3A, first one end of the coil torsion spring 22 is fixed to the longitudinal locking groove 141 of the turning knob pivot post 14, then the driving gear 20 is mounted to the turning knob pivot post 14 of the base plate 10. The other end of the coil torsion spring 22 is fixed to the retaining column 204 of the driving gear 20. Afterwards, the flat insertion portion 211 of turning knob 21 is snapped into engagement with the locking means 202 at the center of the top surface of the driving gear 20 so as to permit the turning knob 21 to be fixed in position by a pin placed in the countersunk fixing hole 212 of the turning knob 21 whereby the driving gear 20 can spin on the turning knob pivot post 14 without detachment therefrom.

Then the driven gear 23 mounted to the pivot post 13 is secured in place by a screw led through the pivot hole 231 of the driven gear 23 on the base plate 10 with the gear teeth thereof in mesh with the gear teeth of the driving gear 20. Afterwards, the position retaining pivot arm 24 is pivotally fixed to the base plate 10 by a pin which is inserted into the central pivot mounting hole 242 of the pivot arm 24 and the mounting hole 15. One end of the compression spring 25 is secured to the retaining rod 161 of the spring retaining seat 16 and the other end is connected to the protruded rod 2431 of the rear pivot handle section 243 of the pivot arm 24. At this moment, the position retaining pivot arm 24 subject to the resilient force of the compression spring 25 is pivoted in such a manner that the retaining head section 241 is brought into limiting engagement with the ratchet teeth 201 of the driving gear 20 rotatably mounted to the turning knob post 14 on the base plate 10.

In a next step, a plurality of steel beads 70 are placed in the peripheral guiding groove 112 of the retaining flange wall 111 of the base plate 10. Afterwards, the longitudinal measurement disc 30 is placed from the top of the base plate 10 to engage with the round cavity 11 of the base plate 10 with the engagement skirt flange 31 of the longitudinal measurement disc 30 in smooth contact with the peripheral guiding groove 112 of the base plate 10. The multiple steel beads 70 are sandwiched between the guiding groove 112 of the base plate 10 and the semi-circular guiding groove 311 of the longitudinal measurement disc 30. The gear teeth on the outer surface of the engagement skirt flange 31 of the longitudinal measurement disc 30 are exposed externally via the cut 114 of the retaining flange wall 111 so as to permit the gear teeth to be engageable with the gear teeth of the driven gear 23.

Next, the first fixing ring lid 33 is attached to the retaining flange wall 111 defined around the round cavity 11 of the base plate 10 by way of the protruded retaining poles 331 engaged with the engaging bores 113 on the retaining flange wall 111. Then a plurality of steel beads 70 are placed in the guiding groove 122 of the right round cavity 12 of the base plate 10 and the lateral measurement disc 40 is placed from the top of the right round cavity 12 to engage with the same. The engagement skirt flange 41 of the lateral measurement disc 40 is engaged with the guiding groove 122 of the base plate 10 with the steel beads 70 sandwiched between the guiding groove 122 of the base plate 10 and the guiding groove 411 of the lateral measurement disc 40.

Furthermore, a number of steel beads 70 are first placed in the semi-circular grooves 421 of the guide tracks 42 rotatably placed in the lateral measurement disc 40; and the left and right slide wings 50 are first engaged with the guide tracks 42 with the steel beads 70 sandwiched between the semi-circular grooves 421 of the guide tracks 42 and the recessed groove 502 of the left and right slide wings 50. Afterwards, one of the ruler frames 52 having differently dimensioned insertion holes 522 can be selectively engaged with the left and right slide wings 50 by way of screws led through the screw holes 501 on the left and right slide wings 50 and the screw holes 5211 of the peripheral side flange 521 of the ruler frame 52. After this, the cover plates 51 are secured to the guide tracks 42 with the protrusions 511 thereof engaged with the insertion holes 4211 of the mounting edge 42 so as to permit the slide wings 50 of the ruler frame 52 to be slidably moved in the guiding tracks 42 of the lateral measurement disc 40 without detachment therefrom. Next, the second fixing ring lid 43 is secured to the retaining flange wall 121 of the right round cavity 12 with the retaining poles 431 of the second fixing ring lid 43 inserted into the insertion holes 123 on the retaining flange wall 121 of the base plate 10. At last, the coupling pin 61 at one end of the link bar 60 is engaged with one of the cylindrical retaining posts 32 of the longitudinal measurement disc 30, and the coupling pin 61 at the opposite end of the link bar 60 is connected to one of the retaining posts 5212 of the ruler frame 52. Thereby, the rotation of the longitudinal measurement disc 30 results in the linear movement of the ruler frame 52 and the simultaneous rotary movement of the lateral measurement disc 40 as a result of the use of the link bar 60. Thus the assembly of the present invention is completed.

Figure 4:
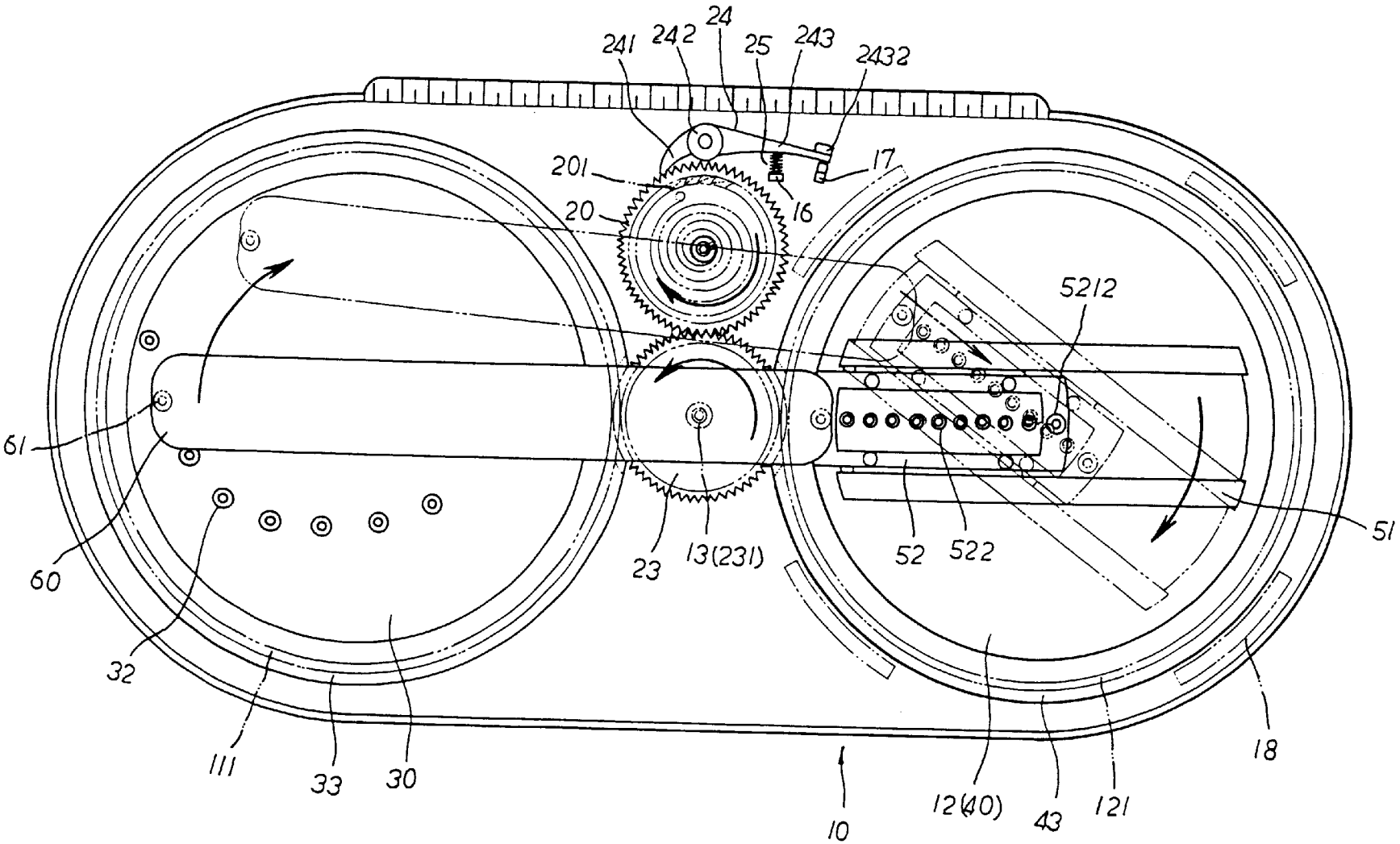
FIG. 4 is a diagram showing the operation mode of the present invention.

Referring to FIG. 4, in practical operation, the turning knob 21 is driven to make the driving gear 20 spin, causing the coil torsion spring 22 to be compressed accordingly. The turning knob 21 is turned to an extent and released. At this moment the driving gear 20 with its ratchet teeth 201 engaged with the retaining head section 241 of the position retaining pivot arm 24. So the driving gear 20 is prevented from rotation by the retaining head section 241. At this moment, an ellipse to be drawn is first set of its dimension, then a pencil or drawing tool is selectively inserted into one of a corresponding insertion holes 522 of the ruler frame 52. Then the position retaining pivot arm 24 is pivoted clockwisely to get the limited driving gear 20 free so that the driving gear 20 spun by the coil torsion spring 22 drives the longitudinal measurement disc 30 to rotate by way of the driven gear 23, as shown in FIG. 4. Simultaneously, the rotated longitudinal measurement disc 30 makes the ruler frame 52 to linearly move back and forth and the lateral measurement disc 40 to rotate by means of the link bar 60. Thereby the point of an inserted pencil in one of the insertion holes 522 of the ruler frame 52 can draw on a piece of paper an ellipse of proper size as a result of the linear and circular motion of the ruler frame 52.

Figure 5:
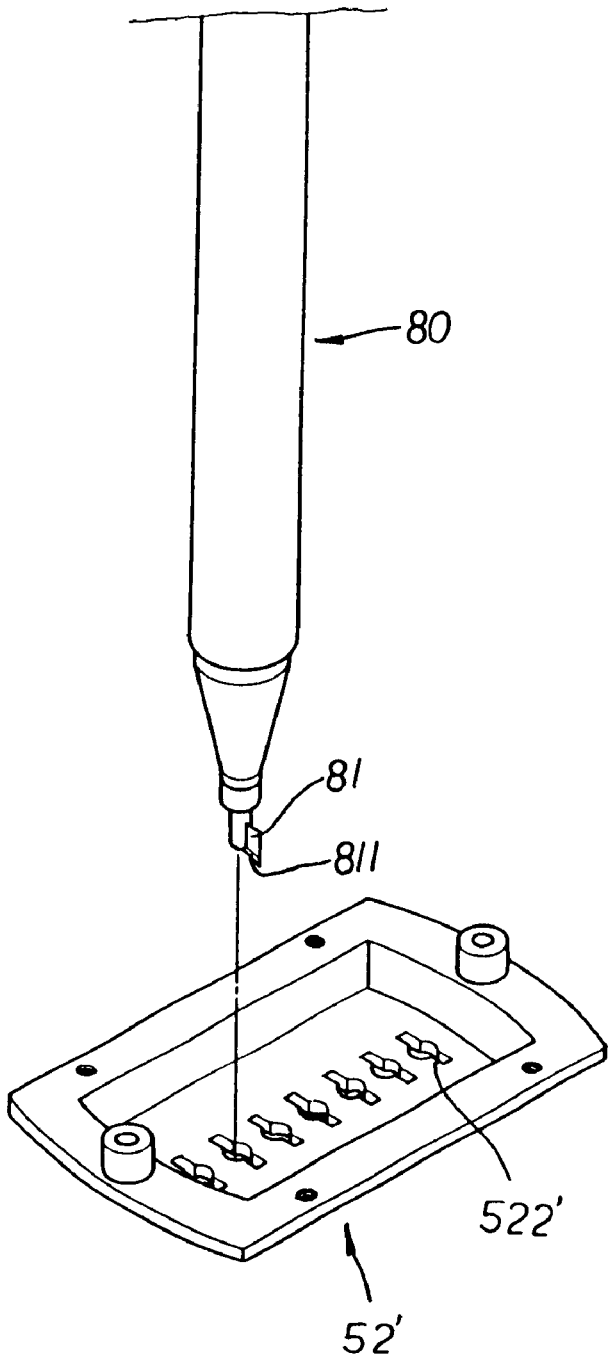
FIG. 5 is a diagram showing the use of a cutting tool in company with a replaced cutting board.

Referring to FIG. 5, if a person wants to cut an ellipse on an object, the ruler frame 52 is replaced by a cutter frame 52' in company with a pen-like cutting knife 80 which is equipped with a cutting piece 81 having a sharpened blade 811 at one lateral end. The insertion holes 522 are substituted by key hole-shaped cutting holes 522'. To cut an ellipse of a desired size off an object, the above cited procedure is repeated for a number of times.

Figure 6:
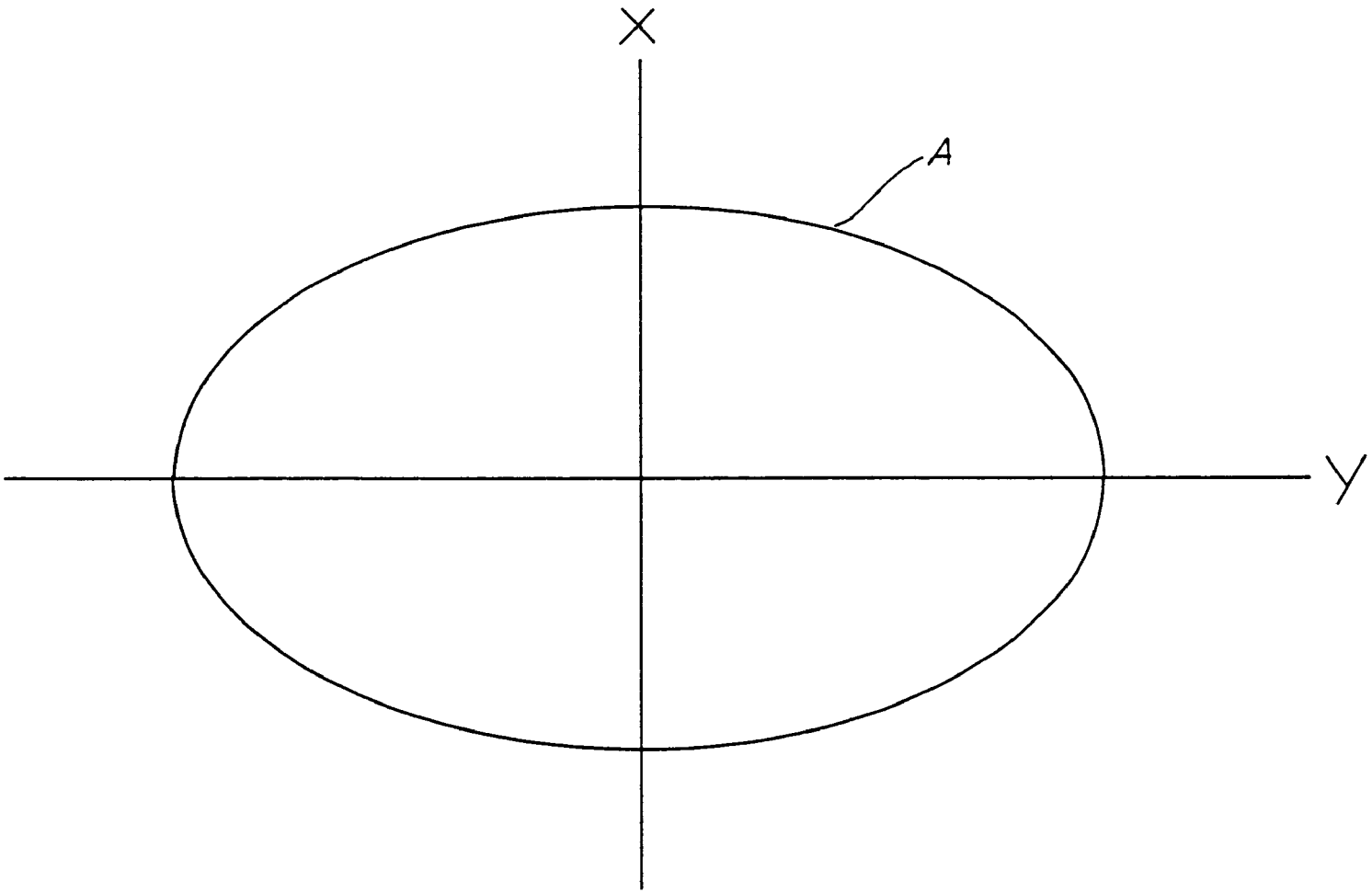
FIG. 6 is a diagram showing a common ellipse drawn according to the lengths of X, Y coordinates.
Figure 7:
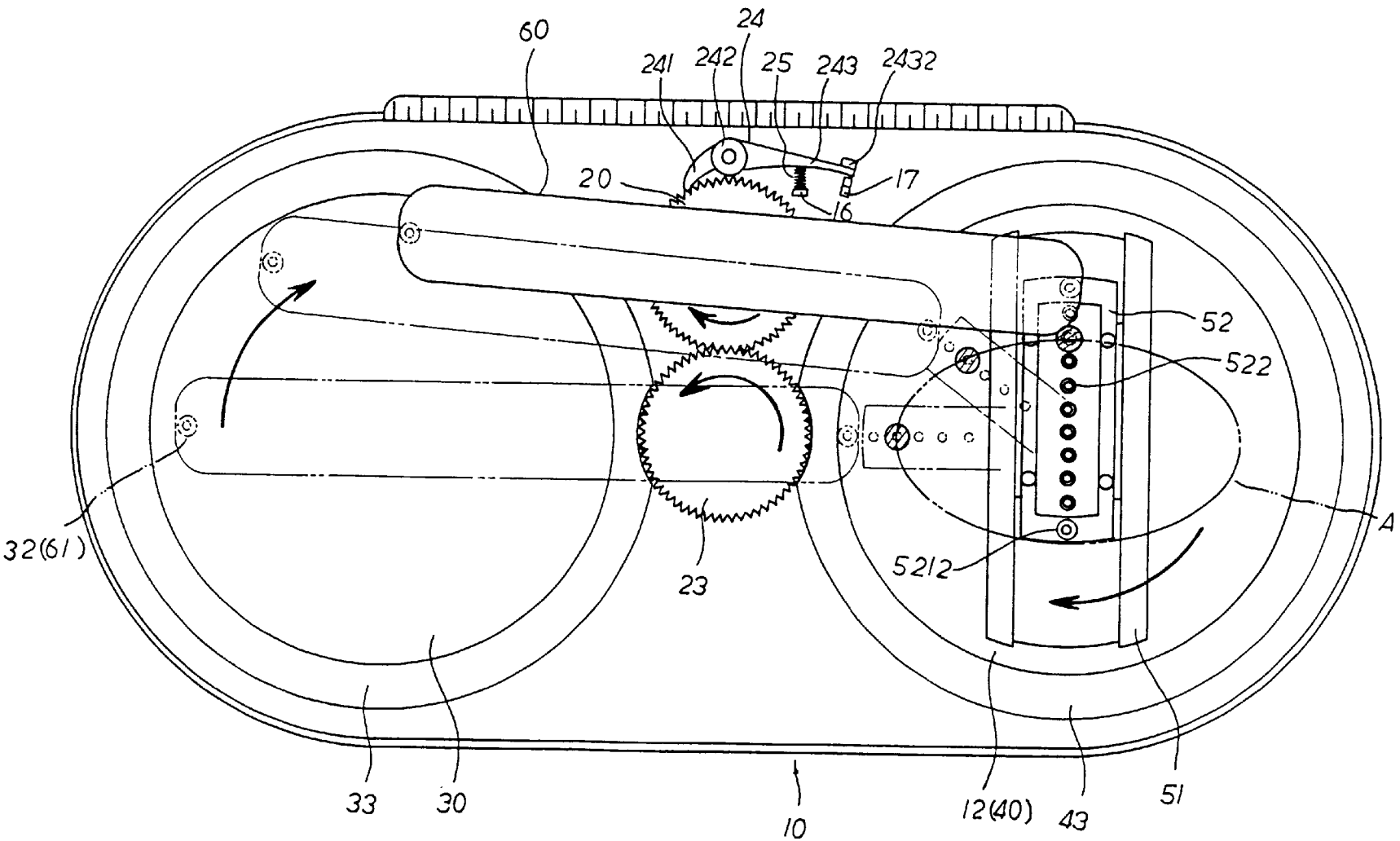
FIG. 7 is a diagram showing an ellipse drawn by the instrument of the present invention.

Referring to FIG. 6, an ellipse A is shown. The lengths of the X and Y coordinates determine an ellipse. So, the setting of the ratio between the X and Y axis lengths permits a person to draw ellipses of various forms with the help of a ruler frame 52. The maximum size of an ellipse drawn by the present invention is limited by the diameters of the longitudinal measurement disc 30 and the lateral measurement disc 40. If larger ellipses are to be drawn, the extension of the diameters of the longitudinal measurement disc 30 and the lateral measurement disc 40 is necessary.

In summary, the advantage of the present invention is that the drawing and cutting become easy and speedy by means of the ruler frame 52 which can be replaced with readiness. The size of ruler frames 52 is small for storage and one ruler frame 52 enables a person to draw or cut a plurality of ellipses of various sizes. So, not too many ruler frames are needed. It is economical for both producers and buyers.

I claim:

1. An ellipse drawing/cutting device, comprising:

a base plate having a left and a right round cavity symmetrically disposed thereon;

a driving gear rotatably mounted to said base plate; and a driven gear rotatably secured to said base plate being in rotary engagement with said driving gear;

a longitudinal measurement disc rotatably engaged with said left round cavity;

a lateral measurement disc rotatably engaged with said right round cavity;

a link bar adapted for linking said longitudinal measurement disc and said lateral measurement disc together so as to permit said discs to act in synchronism with each other;

said driving gear and said driven gear in rotary engagement with each other being rotatably secured in place to said base plate between said left and right round cavities with said driven gear in driving engagement with both said longitudinal measurement disc and said lateral measurement disc so as to permit both said discs to rotate in synchronism with said driven gear;

a slide bracket assembly rotatably disposed in a central cavity of said lateral measurement disc including a ruler frame and a left slide wing, a right slide wing and a pair of parallel guide tracks;

said ruler frame having said right slide wing and said left slide wing removably attached to each longitudinal side thereof being slidably mounted onto said guide tracks of said slide bracket assembly;

at each end of said ruler frame being disposed a retaining post so as to permit each end of said link bar to be connected thereto;

elongated cover plates removably attached to each longitudinal side of said guide tracks of said slide bracket assembly respectively limitedly restraining said right and left slide wings to slide within said guide tracks of said slide bracket assembly;

and a plurality of differently spaced pen insertion holes disposed on said ruler frame, permitting a pen to be selectively inserted in said insertion holes so that ellipses of various sizes can be drawn;

a spring biased position retaining pivot arm in selective engagement with said driving gear;

a turning knob secured to said driving gear being turned in such a direction that said spring operated driving gear is powered to force said driven gear to rotate whereby both said longitudinal measurement disc and said lateral measurement disc are rotated in synchronism and said ruler frame connected to said longitudinal measurement disc is linearly and circularly moved in synchronism to permit an ellipse of selected size to be drawn.

2. The ellipse drawing/cutting device as claimed in claim 1 wherein said link bar has a coupling pin at each end; and on said longitudinal measurement disc are disposed a plurality of cylindrical retaining posts spirally distributed from a center of said longitudinal measurement disc so that said link bar selectively engaged with one of said cylindrical retaining posts at one end by said coupling pin and engaged with one of retaining posts of said ruler frame at the other end by said coupling pin can cause said ruler frame to be linearly moved back and forth in synchronism with a rotary movement of said longitudinal measurement disc to produce an ellipse accordingly.

3. The ellipse drawing/cutting device as claimed in claim 1, wherein both said round cavities have a vertically risen retaining flange wall respectively on a periphery thereof; each said risen retaining flange wall has a peripheral guiding groove disposed adjacent with a plurality of steel beads housed therein; a plurality of spaced engaging bores are distributed on a top of said risen retaining flange wall; a cut is disposed on each of said risen retaining flange walls; a first fixing ring lid and a second fixing ring lid each having a plurality of protruded retaining poles are secured to said top of said risen retaining flange wall with said retaining poles engaged with said engaging bores after said longitudinal measurement disc and said lateral measurement disc are rotatably located in said left and right round cavities.

4. The ellipse drawing/cutting device as claimed in claim 3, wherein said longitudinal measurement disc and said lateral measurement disc are provided with a downwardly folded engagement skirt flange having a semi-circular guiding groove defined thereon for locating steel beads therein whereby said longitudinal measurement disc and said lateral measurement disc mounted to said left and right round cavities respectively with said semi-circular guiding grooves of said round cavities engaged with said semi-circular engagement skirt flanges of said longitudinal and lateral measurement discs can be smoothly rotated in operation.

5. The ellipse drawing/cutting device as claimed in claim 4 wherein said longitudinal measurement disc and said lateral measurement disc are provided with gear teeth on a peripheral edge of said engagement skirt flange respectively and said gear teeth are exposed via said cut on each said risen retaining flange wall whereby both said longitudinal and lateral measurement discs can be driven in synchronism by said driven gear in mesh with said spring biased driving gear.

6. The ellipse drawing/cutting device as claimed in claim 1, wherein at a center of said base plate is disposed a pivot post, a turning knob pivot post and a mounting hole; a longitudinal locking groove is defined on one side of a periphery on said turning knob pivot post; next to said mounting hole a spring retaining seat and a limiting post are disposed; a horizontal retaining rod extends from one side of said spring retaining seat; said driving gear is a two-layer disc having a large disc provided with gear teeth on a peripheral surface thereof and a small ring under said large disc; on a peripheral surface of said small ring are disposed a plurality of continuous ratchet teeth; a central receiving cavity is defined in said small ring on an underside of said driving gear and on a top surface of said driving gear is disposed a locking means for fixing of said turning knob; in said central receiving cavity and at one point near said small ring is disposed a retaining column; said turning knob is a two-stage cylinder block having a small diameter rod and a flat insertion portion which can engage with said locking means of said driving gear whereby said spring biased driving gear can be rotated by hand to drive said longitudinal and lateral measurement discs via said driven gear in synchronism.

7. The ellipse drawing/cutting device as claimed in claim 1 wherein said ruler frame is replaceable with spare ruler frames for drawing ellipses of various sizes.

8. The ellipse drawing/cutting device as claimed in claim 1 wherein said ruler frame can be replaced by a cutter frame whereby ellipses can be cut off on a working object by way of a pen-like knife which is engaged with said cutter frame in operation.

9. The ellipse drawing/cutting device as claimed in claim 1 wherein said insertion holes are marked with measurement dimensions indicating sizes of ellipses to be drawn if a pen is inserted in said insertion hole.

10. The ellipse drawing/cutting device, comprising:

a base plate having a left and a right round cavity symmetrically disposed thereon;

a driving gear and a driven gear in rotational engagement with each other;

a longitudinal measurement disc rotatably engaged with said left round cavity;

a first fixing ring lid for said longitudinal measurement disc removably fixed to a peripherally raised flange wall around said left round cavity after said longitudinal measurement disc being fixed in position;

a lateral measurement disc rotatably engaged with said right round through hole;

a second fixing ring lid for said lateral measurement disc removably fixed to a peripherally raised flange wall around said right round cavity after said lateral measurement disc being fixed in position;

a link bar adapted for linking said longitudinal measurement disc and said lateral measurement disc together so as to permit said discs to act in synchronism with each other;

said driving gear and driven gear in rotary engagement with each other being rotatably secured in place between said left and right round through holes with said driven gear in driving engagement with both said longitudinal measurement disc and said lateral measurement disc so as to permit both said discs to rotate in synchronism with said driven gear;

a turning knob securely fixed at a center of said driving gear so as to permit said driving gear to be manually turned to spin;

a coil torsion spring fixedly disposed under the driving gear so as to permit said driving gear to be retractably rotated when said turning knob fixedly mounted to the center of said driving gear is rotated manually and conditionally released to spin;

a position retaining arm pivotally secured to said base plate and selectively in restraint engagement with said driving gear so as to conditionally limit said driving gear to spin;

a compression spring having one end engaged with said position retaining arm and the other end engaged with said spring retaining seat on said base plate so as to permit said position retaining arm to be retractably operated;

a slide bracket assembly rotatably disposed in a cavity of said lateral measurement disc comprising: a ruler frame having a right slide wing and a left slide wing removably attached to each longitudinal side thereof and a pair of parallel guide tracks; said ruler frame being slidably mounted onto said slide bracket assembly;

elongated cover plates removably attached to each longitudinal side of said slide bracket assembly so as to restrain said right and left slide wing to move within said parallel tracks;

a plurality of steel beads being housed in grooves of said rotary longitudinal and lateral measurement discs and said slidable ruler frame so as to make said discs and said ruler frame to be smoothly moved;

a plurality of anti-slip blocks disposed under said base plate;

and a plurality of differently spaced pen insertion holes being on said ruler frame;

both said left and right round cavities having a vertically risen retaining flange wall respectively on the periphery thereof; each said risen retaining flange wall having a peripheral guiding groove disposed adjacent thereto;

a plurality of spaced engaging bores are distributed on a top of said risen retaining flange wall; a cut is disposed at on each of said risen retaining flange walls;

at a center of said base plate is disposed a pivot post, a turning knob pivot post and a mounting hole;

a longitudinal locking groove being defined on one side of a periphery of said turning knob pivot post;

next to said mounting hole a spring retaining seat and a limiting post being disposed;

a horizontal retaining rod extending from one side of said spring retaining seat for holding one end of said compression spring;

said driving gear being a two-layer disc having a large disc provided with gear teeth on a peripheral surface thereof and a small ring portion under said large disc;

on a peripheral surface of said small ring portion being disposed a plurality of continuous ratchet teeth with which said position retaining arm is selectively engaged;

a central receiving cavity being defined in said small ring portion on an underside of said driving gear and on a top surface of said driving gear being disposed a locking means for fixing of said turning knob; in said central receiving cavity and at one point near said small ring being disposed a retaining column;

said link bar having a coupling pin at each end for engagement with said ruler frame and said longitudinal measurement disc;

on said longitudinal measurement disc being disposed a plurality of cylindrical retaining posts spirally distributed from a center of said longitudinal measurement disc so that said link bar selectively engaged with one of said cylindrical retaining posts at one end by said coupling pin and engaged with one of retaining posts defined at each end of said ruler frame at the other end by said coupling pin can cause said ruler frame to be linearly moved back and forth in synchronism with a rotary movement of said longitudinal measurement disc to produce an ellipse accordingly;

both said round cavities having a vertically risen retaining flange wall respectively on a periphery thereof;

each said risen retaining flange wall having a peripheral guiding groove disposed adjacent thereto with a plurality of said steel beads housed therein;

a plurality of spaced engaging bores being distributed on a top of said risen retaining flange wall;

a cut being disposed on each of said risen retaining flange walls;

a first fixing ring lid and a second fixing ring lid each having a plurality of protruded retaining poles being secured to said top of said risen retaining flange wall with said retaining poles engaged with said engaging bores after said longitudinal measurement disc and said lateral measurement disc being rotatably located in said left and right round cavities;

said longitudinal measurement disc and said lateral measurement disc respectively having a downwardly folded engagement skirt flange having a semi-circular guiding groove defined thereon for locating steel beads therein whereby said longitudinal measurement disc and said lateral measurement disc mounted to said left and right round cavities respectively with said semi-circular guiding grooves of said round cavities engaged with said semi-circular engagement skirt flanges of said longitudinal and lateral measurement discs can be smoothly rotated in operation;

said longitudinal measurement disc and said lateral measurement disc being provided with gear teeth on a peripheral edge of said engagement skirt flange respectively and said gear teeth are exposed via said cut on each said risen retaining flange wall whereby both said longitudinal and lateral measurement discs can be driven in synchronism by said driven gear in mesh with said spring biased driving gear;

at a center of said base plate being disposed a pivot post, a turning knob pivot post and a mounting hole;

a longitudinal locking groove being defined on one side of a periphery on said turning knob pivot post;

next to said mounting hole a spring retaining seat and a limiting post being disposed;

a horizontal retaining rod extends from one side of said spring retaining seat;

said driving gear being a two-layer disc having a large disc provided with gear teeth on a peripheral surface thereof and a small ring under said large disc;

on a peripheral surface of said small ring being disposed a plurality of continuous ratchet teeth;

a central receiving cavity being defined in said small ring on an underside of said driving gear and on a top surface of said driving gear being disposed a locking means for fixing of said turning knob;

in said central receiving cavity and at one point near said small ring being disposed a retaining column;

said turning knob being a two-stage cylinder block having a small diameter rod and a flat insertion portion which can engage with said locking means of said driving gear whereby said spring biased driving gear can be rotated by hand to drive said longitudinal and lateral measurement discs via said driven gear in synchronism.

11. The ellipse drawing cutting device as claimed in claim 10 wherein said ruler frame is replaceable with spare ruler frames for drawing ellipses of various sizes.

12. The ellipse drawing/cutting device as claimed in claim 10 wherein said ruler frame can be replaced by a cutter frame whereby ellipses can be cut off on a working object by way of a pen-like knife which is engaged with said cutter frame in operation.

13. The ellipse drawing/cutting device as claimed in claim 10 wherein said insertion holes are marked with measurement dimensions indicating sizes of ellipses to be drawn if a pen is inserted in said insertion hole.

* * * * *